US010424421B2

(12) United States Patent
Huang et al.

(10) Patent No.: US 10,424,421 B2
(45) Date of Patent: Sep. 24, 2019

(54) FLAT CABLE

(71) Applicant: Amphenol AssembleTech (Xiamen) Co., Ltd, Xiamen (CN)

(72) Inventors: Zhiming Huang, Xiamen (CN); Wenchu Yang, Xiamen (CN); Bilu Li, Xiamen (CN); Zhiwei Chen, Xiamen (CN); Yin Ye, Xiamen (CN)

(73) Assignee: Amphenol AssembleTech (Xiamen) Co., Ltd, Xiamen (CN)

( * ) Notice: Subject to any disclaimer, the term of this patent is extended or adjusted under 35 U.S.C. 154(b) by 0 days.

(21) Appl. No.: 15/896,044

(22) Filed: Feb. 13, 2018

(65) Prior Publication Data

US 2019/0096542 A1 Mar. 28, 2019

(30) Foreign Application Priority Data

Sep. 22, 2017 (CN) ..... 2017 1 0866491

(51) Int. Cl.

| | |
|---|---|
| ***H01B 7/08*** | (2006.01) |
| ***H01B 7/02*** | (2006.01) |
| ***H01B 11/00*** | (2006.01) |
| ***H01B 13/06*** | (2006.01) |
| ***H01B 13/14*** | (2006.01) |
| ***H01B 11/20*** | (2006.01) |

(52) U.S. Cl.

CPC ..... *H01B 7/0838* (2013.01); *H01B 7/0275* (2013.01); *H01B 7/0807* (2013.01); *H01B 11/002* (2013.01); *H01B 11/203* (2013.01); *H01B 13/06* (2013.01); *H01B 13/14* (2013.01)

(58) Field of Classification Search

CPC ..... H01B 7/08
USPC ..... 174/117 F
See application file for complete search history.

(56) References Cited

U.S. PATENT DOCUMENTS

| | | | | |
|---|---|---|---|---|
| 4,468,089 | A * | 8/1984 | Brorein | G02B 6/4403 156/53 |
| 5,900,588 | A * | 5/1999 | Springer | H01B 7/0861 174/117 F |
| 6,410,848 | B1 * | 6/2002 | Shrader | H01B 7/186 174/36 |
| 6,504,379 | B1 * | 1/2003 | Jackson | H01B 7/0861 174/117 F |
| 10,090,612 | B2 * | 10/2018 | Benedict | H01B 7/0823 |
| 2013/0277088 | A1 * | 10/2013 | Gundel | H01B 7/0838 174/107 |

* cited by examiner

*Primary Examiner* — Chau N Nguyen
(74) *Attorney, Agent, or Firm* — Gokalp Bayramoglu

(57) ABSTRACT

The present invention discloses a flat cable, which comprises signal unit sets and the insulating layer which wraps and fixes the signal unit set. The signal unit set is formed by at least two signals units arranged substantially on the same plane at an interval or side by side. The left and right sides of the signal unit set are directly wrapped by insulating layers. The insulating layer is formed by splicing and bonding at least one insulating film, and the splicing points at two ends of the insulating film are located on the upper side or the lower side of the signal unit set. In the flat cable of the present invention, the length of the overlapping portion can be set as required, effectively preventing the phenomenon such as insulating film tear and short circuit caused by insulating film tear.

12 Claims, 10 Drawing Sheets

FLAT CABLE

CROSS REFERENCE TO RELATED APPLICATIONS

This application is based on upon and claim priority to Chinese Patent Application CN 201710866491.1 filed on Sep. 22, 2017, the entire content of which is incorporated herein by reference.

TECHNICAL FIELD

The present invention belongs to the field of communication wires, in particular to a flat cable.

BACKGROUND

Referring to FIG. 1, in the prior art, the flat cable generally includes the signal unit set 10 formed by arranging a plurality of signal units 101 on the same plane. The upper and lower surfaces of the signal unit set 10 are covered with insulating films 11, 12. The upper and lower insulating films 11, 12 are laterally extended by a small length on both sides of the signal unit set, and are bonded to each other. Recently, based on the considerations of width of the wire and aesthetics, the width of the small extension is generally less than 1 mm. During use, it is likely to cause the insulating film to be easily peeled off, resulting in short-circuit and other consequences, affecting the use of the product.

SUMMARY OF THE INVENTION

In order to solve the above technical problems, the objective of the present invention is to provide a flat cable with stable performance, non-perishable insulation layer and longer product life.

In order to achieve the above objectives, the technical solution provided by the present invention is: a flat cable includes signal unit sets and the insulating layer for wrapping and fixing the signal unit set. The signal unit set is formed by at least two signals units arranged substantially on the same plane at an interval or side by side; the left and right sides of the signal unit set are directly wrapped by the insulating layer; the insulating layer is molded through integral extrusion injection molding or hot press molding; or the insulating layer is formed by splicing and bonding at least a piece of insulating film, and the splicing points at two ends of the insulating film are located on the upper side or the lower side of the signal unit set.

Further, the insulating film and the signal unit are adhered and fixed by an adhesive. The adhesive includes (but are not limited to) polyesters, polyimides, polyamide-imides, teflon, polypropylene, polyethylene, polyphenylene sulphide, PEN (Polyethylene naphthalate two formic acid glycol ester), polycarbonates, silicone rubbers, ethylene propylene diene rubbers, polyurethanes, acrylates, silicones, natural rubbers, epoxies and synthetic rubber adhesives.

Further, a gap is disposed between the signal units and between the signal unit and the insulating film, or the gap is filled with a filling layer, and the filling layer is preferably an insulating glue or an insulating varnish.

Further, the splicing points at the two ends of the insulation film has an overlapping adhesive portion, the length of the overlapping adhesive portion is ≥1 mm; and the length is preferably ≥width of the signal unit.

Further, the insulating film is one piece, and the insulating film warps the entire upper surface or the lower surface of the signal unit set, after extending from both sides to the other surface, the two ends of the insulating film are spliced and bonded together. Or the insulating film comprises two pieces, the upper and lower surfaces of the signal unit set are respectively wrapped from one side of the signal unit set, and are spliced respectively on the upper and lower surfaces of the signal unit set. Or the insulating film comprises two pieces, the first insulating film wraps the entire upper surface, or the entire lower surface of the signal unit set and extends from both sides to the other surface, and the second insulating film is pasted on the first insulating film, covered at both ends of the first insulation film.

Further, the insulating film adapts PET, PFA, FEP, PE, etc.

Further, in a preferred mode, the insulating film is also provided with a metal foil layer on the lower surface, the metal foil layer can achieve the shielding effect, to prevent signal crosstalk.

Further, in a preferred mode, the overlapping adhesive portion is formed by extending and bonding the insulating film which covers the upper portion of the signal unit set.

Further, in another preferred mode, the insulating layer includes upper insulating film and lower insulating film, metal foil layer is further disposed between the upper insulating film and the lower insulating film. This solution, enables to achieve a good bending memory function of the cable.

Further, in a preferred mode, the overlapping adhesive portion is formed by extending and bonding the upper insulating film and the lower insulating film which covers the upper insulating layer.

Further, the metal foil used in the metal foil layer is aluminum foil, copper foil, silver foil or gold foil, preferably aluminum foil.

Further, in a preferred mode, when a high-speed transmission needs to be implemented, the signal unit in the signal unit set includes a differential signal unit.

Further, when a control function needs to be implemented on the high-speed transmission data line, the signal unit in the signal unit set further includes a control signal unit, and the arrangements between the differential signal unit and the control signal unit are random.

Compared with the prior art, in the flat cable according to the present invention, the insulating layer is integrally formed or the splicing portion is disposed on the upper surface or the lower surface of the signal unit set. Since the length of the overlapping bonding portion can be set as required, effectively preventing the phenomenon such as tear of insulating film and short circuit caused by tear of insulating film. Since the insulating layer is a thin layer, the bonding marks of the upper surface or the lower surface will not be seen easily, so the appearance of wire is more aesthetic.

DETAILED DESCRIPTION OF THE INVENTION

The present invention will be further described below with reference to the accompanying drawings.

Figure 1:
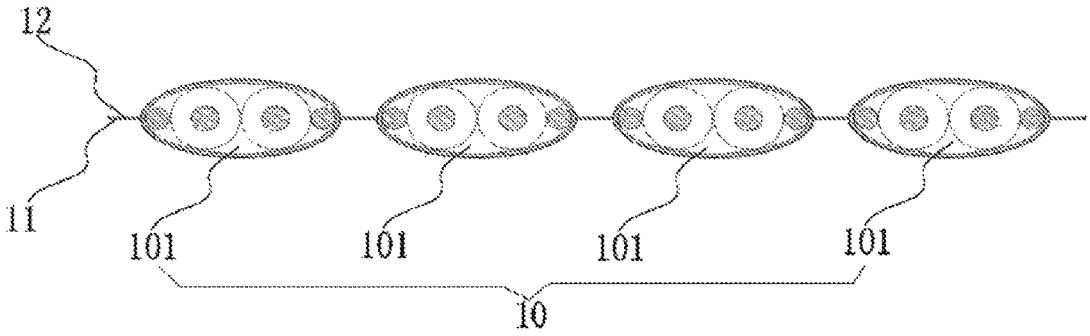
FIG. 1 PRIOR ART
FIG. 1 is a schematic diagram of the flat cable of the prior art.
Figure 2:
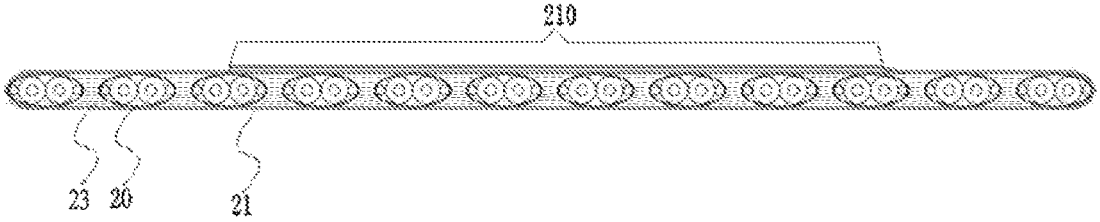
FIG. 2 is a schematic diagram of the flat cable according to a first embodiment of the present invention.

As shown in FIG. 2, a schematic diagram of the flat cable according to a first embodiment of the present invention is shown. The flat cable according to the present invention includes signal unit sets and the insulating film 21 for wrapping and fixing the signal unit set. The unit set includes at least two signal units 20 arranged substantially on the same plane at an interval or side by side. The insulating layer is formed by insulating film 21, the insulating film 21 warps the entire lower surface of the signal unit set and extends from both sides of the lower surface of the signal unit set to the upper surface of the signal unit set, and the two ends of the insulating film 21 are spliced and bonded together. The insulating film 21 and the signal unit 20 are adhesively fixed by an adhesive, and the insulating film 21 of the upper surface and lower surface are not in contact with each other. The adhesive includes (but are not limited to) polyesters, polyimides, polyamide-imides, teflon, polypropylene, polyethylene, polyphenylene sulphide, PEN (Polyethylene naphthalate two formic acid glycol ester), polycarbonates, silicone rubbers, ethylene propylene diene rubbers, polyurethanes, acrylates, organosilicones, natural rubbers, epoxies and synthetic rubber adhesives.

In addition, the overlapping adhesive portion 210 is disposed between the splicing points at both ends of the insulating film 21, it has been shown through practice, when the length of the overlapping adhesive portions 210 is equal to or more than 1 mm, a better bonding effect can be obtained. Particularly, when the length of the overlapping adhesive portion 210 is equal to or more than the width of signal unit, the bonding effect is better, and the insulating film does not break easily.

In this way, the two sides of the flat cable are directly covered by a single insulating film, and the splicing portion of the insulating film is arranged on the upper surface or the lower surface of the signal unit set. Since the length of the overlapping bonding portion can be set as required, it effectively prevents the phenomenon such as the tear of insulating film and short circuit caused by the damaged insulating film. Since the insulating film is a thin film, the bonding marks of the upper surface or the lower surface will not be seen easily, so that the appearance of wire is more aesthetic.

Further, as needed, the gap between the signal units and between the signal unit and the insulating film is filled with filling layer. The filling layer may be an insulating glue 23 or an insulating varnish 24. By filling with the filling layer, the whole wire can be more reliable.

Figure 3:
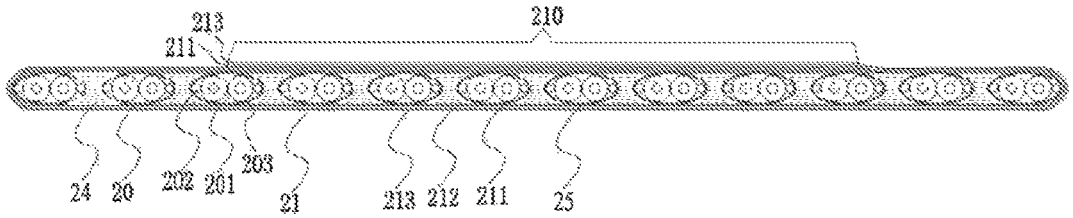
FIG. 3 is a schematic diagram of the flat cable according to a second embodiment of the present invention.

Further, referring to FIG. 3, a schematic diagram of the flat cable according to a second embodiment of the present invention is shown. In order to transmit high-speed signals, the signal unit 20 in the cable can be differential signal unit. The differential signal unit includes the first core line 201, the first earth line 202 and the first shielding insulating film 203 warping the first core line 201 and the first earth line 202. The first core line 201 comprises two first core wires, each of the first core wire comprises a conductor and a longitudinal insulator wrapping the conductor. The shielding and insulation of the differential signal unit are achieved by the first shielding insulating film 203, and the first shielding insulating film 203 is preferably an aluminum foil layer. According to the requirements, the signal unit in the signal unit set further includes the control signal unit 25. And the arrangements between the differential signal unit and the control signal unit are random in the flat cable. In this way, the high-speed transmission of signals can be achieved through the differential signal unit, the system operation and identification function of the high-speed flat cable can be achieved through the control signal unit.

Further, the insulating film can be made of materials such as PET, PFA, FEP and PE. In case for increasing the shielding performance of the cable, a metal foil layer is disposed on the lower surface of the insulating film. In this way the interference signals can be further shielded. The metal foil in the above metal foil layer is made of aluminum foil, copper foil, silver foil, gold foil and alloy foil, etc., and is preferably aluminum foil. In this way, in order to prevent electric conduction accident of the metal foil, the overlapping adhesive portion is formed by extending and bonding the insulating film covering the upper portion of the signal unit set, so that the metal foil layer does not extend to the overlapping adhesive portion, effectively preventing the metal foil layer from contacting with external layers, and provides a better protection.

Figure 4:
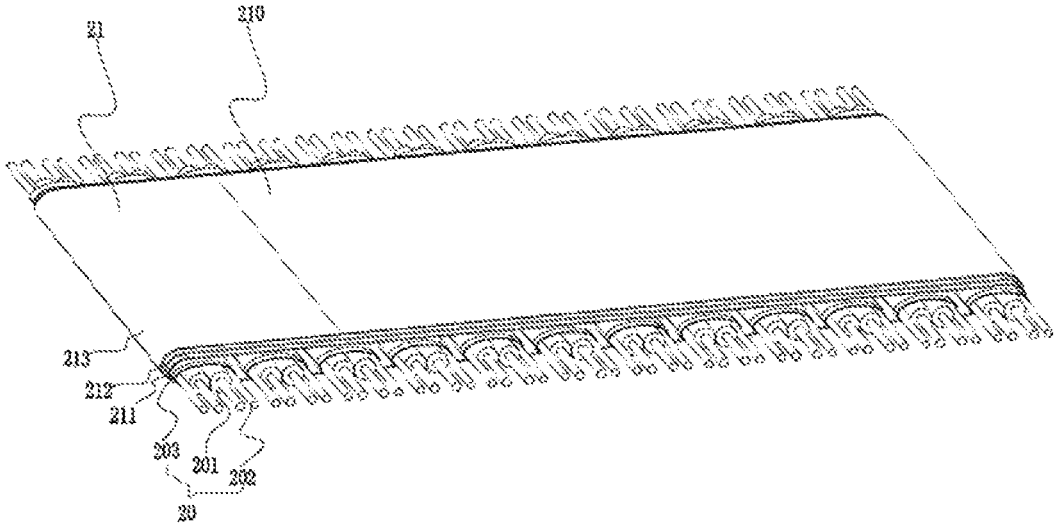
FIG. 4 is a perspective view of FIG. 3.

Further, if the bending memory function of the cable needs to be provided, as shown in FIG. 3 and FIG. 4, the insulating film 21 includes the upper insulating film 211 and the lower insulating film 213. And metal foil layer 212 is disposed between the upper insulating film 213 and the lower insulating film 211. The memory function of the metal foil layer 212 can be fully utilized to achieve the folding memory effect of the flat cable, enable the high-speed flat cable to not rebound after bending. At the same time, the existence of the upper insulating film and the lower insulating film can effectively prevent the cracking of the metal foil layer, enhance the toughness of the bent composite layer, makes it easier to bend the entire bent composite layer, and enhance the service life of the cable at the same time. The metal foil in the above metal foil layer is made of aluminum foil, copper foil, silver foil, gold foil, alloy foil and etc., and is preferably aluminum foil. In this way, in order to prevent the hidden dangers such as the short circuit caused by electric conduction of the aluminum foil layer, the overlapping adhesive portion 210 is formed by extending and bonding the upper insulating film 211 and the lower insulating film 213 of insulating film 21 covering the upper insulating film, and the metal foil layer does not extend to the overlapping adhesive portion 210, the contact between the metal foil layer and the outside can be effectively prevented, and a better protection can be achieved.

Figure 5:
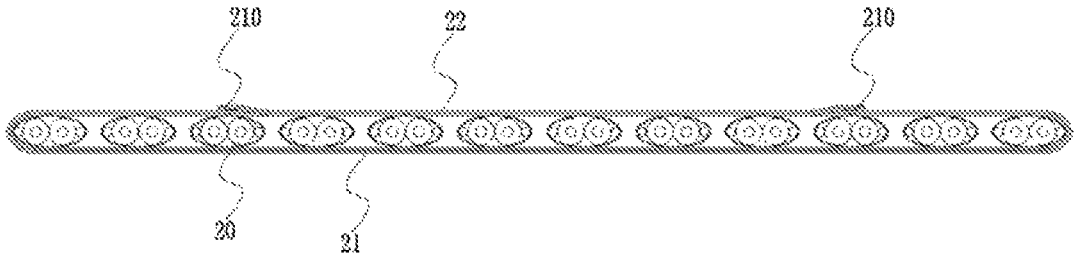
FIG. 5 is a schematic diagram of the flat cable according to a third embodiment of the present invention.

Referring to FIG. 5, in a third embodiment, the difference from the first embodiment as shown in FIG. 2 lies in that the insulating film according to the third embodiment of the present invention includes two pieces and the signal units 20 are closely arranged. The insulating film includes the first insulating film 21 and the second insulating film 22. The first insulating film 21 warps the entire surface of the lower surface of the signal unit set and extends from both sides of the signal unit set to the upper surface. The second insulating film 22 is adhered to the upper surface of the first insulating film 21, and both ends of the first insulating film 21 are covered and adhered by the second insulating film 22 to form the overlapping adhesive portion 210.

Figure 6:
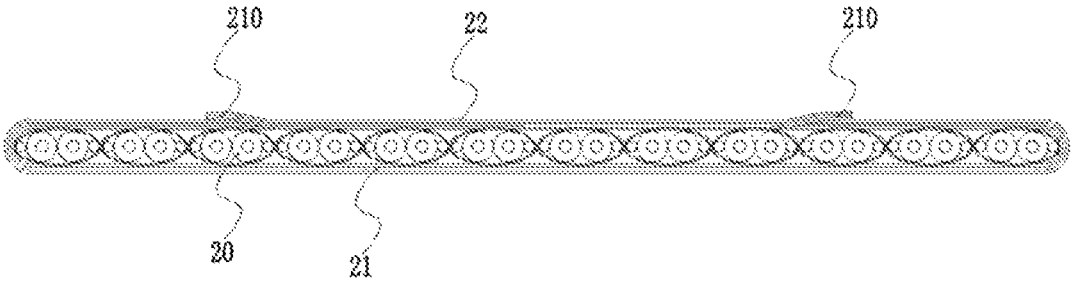
FIG. 6 is a schematic diagram of the flat cable according to a fourth embodiment of the present invention.

Referring to FIG. 6, in a fourth embodiment, a difference from the third embodiment as shown in FIG. 5 lies in that the signal units 20 according to the fourth embodiment of the present invention are arranged in close proximity.

Figure 7:
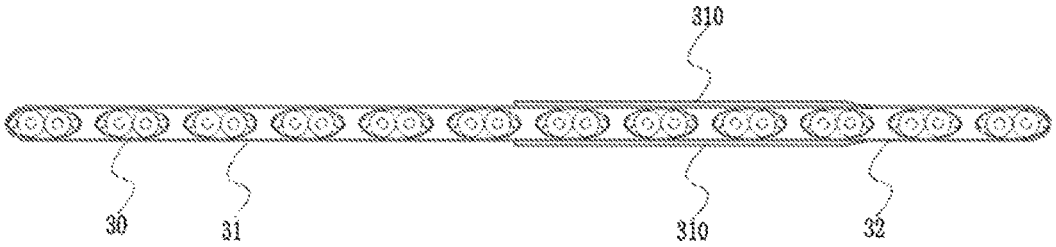
FIG. 7 is a schematic diagram of the flat cable according to a fifth embodiment of the present invention.

Referring to FIG. 7, a fifth embodiment of the present invention is shown. The difference from the first embodiment as shown in FIG. 2 lies in that the insulating film 31 and the insulating film 32 are respectively wrapped the upper and lower surfaces of the signal unit 30 from one side of the signal unit set, and respectively spliced together on the upper surface and the lower surface of the signal unit set, to form the overlapping adhesive portion 310.

Figure 8:
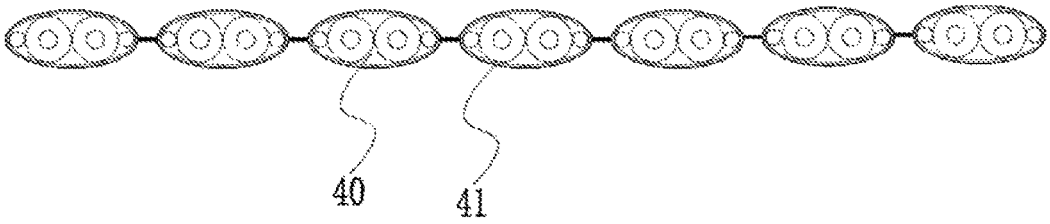
FIG. 8 is a schematic diagram of the flat cable according to a sixth embodiment of the present invention.

Referring to FIG. 8, a sixth embodiment of the present invention is shown. In the embodiment, the insulating layer is integrally extrusion-injection-molded, so that the signal unit 40 is wrapped by the integrated insulating layer 41, the signal unit set can be isolated through the insulating layer. In addition, the insulation layer can also be replaced with plastic coating.

Figure 9:
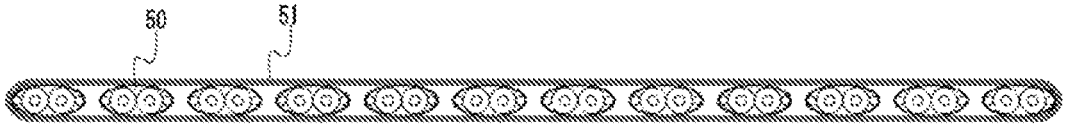
FIG. 9 is a schematic diagram of the flat cable according to a seventh embodiment of the present invention.
Figure 10:
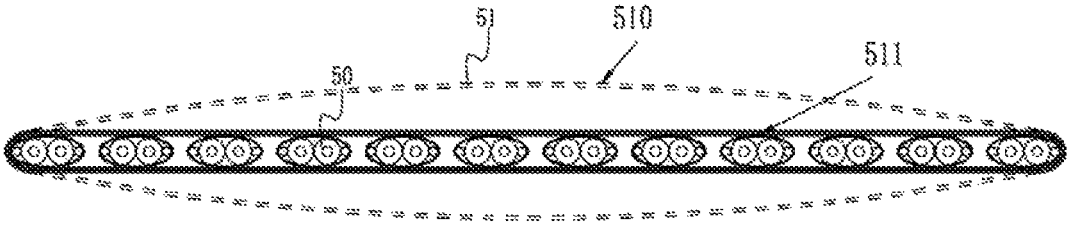
FIG. 10 is a schematic diagram of the hot press molding process of FIG. 9.

Referring to FIG. 9 and FIG. 10, a seventh embodiment of the present invention is shown in FIG. 9, and a hot press molding process of FIG. 9 is shown in FIG. 10. In the seventh embodiment, the insulating layer is an insulating plastic sleeve 51, and the signal unit 50 is arranged side by side in the insulating plastic sleeve 51. After hot press molding, the hot-pressed plastic sleeve is directly formed the adhesive layer on the signal unit. Referring to FIG. 10, the broken line 510 refers to the sleeved thin sleeve before the hot press molding, the solid line 511 is the adhesive layer formed after hot pressing.

The above are only the preferred embodiments of the present invention, but not intended to limit the present invention in any other form. Those skilled in the art may use the disclosed technical content to change or modify the equivalent embodiment. However, any simple modifications, equivalent changes made to the above embodiments according to the technical essence of the present invention still fall within the protection scope of the technical solutions of the present invention.

What is claimed is:

1. A flat cable comprising a signal unit set and an insulating layer wrapping and fixing the signal unit set, wherein the signal unit set comprises at least a first signal unit and a second signal unit; and the first signal unit and the second signal unit are substantially arranged on the same plane at intervals or in close proximity, and a left side and a right side of the signal unit set are directly wrapped by the insulating layer;

the insulating layer is formed by splicing and bonding at least a piece of insulating film, the insulating film comprises a first end and a second end, and a splicing point at the first end and the second end of the insulation film is located on an upper side or a lower side of the signal unit set;

wherein an overlapping adhesive portion is formed between the splicing point at the first end and the second end of the insulating film, and a length of the overlapping adhesive portion is greater than or equal to 1 mm and the length of the overlapped adhesive portion is greater than or equal to a width of the first signal unit or the second signal unit;

wherein the insulating film and the first signal unit and the second signal unit are bonded and fixed by an adhesive, and the insulating film on an upper surface of the signal unit set, and the insulating film on a lower surface of the signal unit set, are not in contact with each other;

wherein a gap is disposed between the first signal unit and the second signal unit and between the signal unit set and the insulating film, wherein the gap is filled with a filling layer; and the filling layer is an insulating glue or an insulating varnish.

2. The flat cable according to claim 1, wherein the insulating film is one piece structure, and the insulating film entirely wraps the upper surface of the signal unit set and extends from the left side and the right side to the lower surface of the signal unit set; or the insulating film entirely wraps the lower surface of the signal unit set and extends from the right side and the left side to the upper surface of the signal unit set, the first end and the second end of the insulating film are spliced together.

3. The flat cable according to claim 1, wherein the insulating layer comprises a first insulating film and a second insulating film, the first insulating film warps the upper surface and the lower surface of the signal unit set from the left side of the signal unit set; and the second insulating film wraps the lower surface and the upper surface of the signal unit set from the right side of the signal unit set, and the insulating layer is formed by splicing the first insulating film and the second insulating film on the upper surface, and splicing the first insulating film and the second insulating film on the lower surface.

4. The flat cable according to claim 1, wherein the insulating film comprises a first insulating film and a second insulating film, the first insulating film entirely wraps the upper surface of the signal unit set and extends from the left side and the right side to the lower surface of the signal unit set or the first insulating film wraps the lower surface of the signal unit set and extends from the right side and left side to the upper surface, the second insulating film is bonded to the first insulating film, and a first end and a second end of the first insulating film are pasted and covered.

5. The flat cable according to claim 1, wherein a metal foil layer is further disposed on the lower surface of the insulating film.

6. The flat cable according to claim 5, wherein the overlapping adhesive portion is formed by extending and bonding the insulating film covering an upper portion of the signal unit set.

7. The flat cable according to claim 1, wherein the insulating layer comprises an upper insulating film and a lower insulating film, and a metal foil layer is disposed between the upper insulating film and the lower insulating film.

8. The flat cable according to claim 7, wherein the overlapping adhesive portion is formed by extending and bonding the upper insulating film and the lower insulating film covering an upper portion of the signal unit set.

9. The flat cable according to claim 1, wherein the first signal unit and/or the second signal unit is a differential signal unit.

10. The flat cable according to claim 9, wherein the first signal unit and/or the second signal unit is a control signal unit, and the differential signal unit and the control signal unit are arranged randomly.

11. The flat cable according to claim 1, wherein the insulating layer is a plastic coating.

12. The flat cable according to claim 1, wherein the insulating layer is an insulating plastic sleeve.

* * * * *